US009647361B2

(12) United States Patent
Kobuchi et al.

(10) Patent No.: US 9,647,361 B2
(45) Date of Patent: May 9, 2017

(54) CONNECTOR

(71) Applicant: JAPAN AVIATION ELECTRONICS INDUSTRY, LIMITED, Shibuya-ku, Tokyo (JP)

(72) Inventors: Toshiro Kobuchi, Tokyo (JP); Takayuki Nishimura, Tokyo (JP); Hiroaki Obikane, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/231,930

(22) Filed: Aug. 9, 2016

(65) Prior Publication Data

US 2017/0098900 A1 Apr. 6, 2017

(30) Foreign Application Priority Data

Oct. 1, 2015 (JP) ..... 2015-195943

(51) Int. Cl.
*H01R 12/71* (2011.01)
*H01R 12/70* (2011.01)
*H01R 13/405* (2006.01)

(52) U.S. Cl.
CPC ..... *H01R 12/712* (2013.01); *H01R 12/707* (2013.01); *H01R 12/716* (2013.01); *H01R 13/405* (2013.01)

(58) Field of Classification Search
CPC ..... H01R 12/712
See application file for complete search history.

(56) References Cited

U.S. PATENT DOCUMENTS 5,356,299 A * 10/1994 Kunishi et al. ..... H01R 12/57 439/78
8,523,580 B2 9/2013 Midorikawa et al.
8,888,506 B2 11/2014 Nishimura et al.
(Continued)

FOREIGN PATENT DOCUMENTS

JP 09283195 A 10/1997
JP 5369125 B2 12/2013
JP 5624180 B2 11/2014

OTHER PUBLICATIONS

Extended European Search Report (EESR) dated Jan. 12, 2017 issued in counterpart European Application No. 16183833.9.

*Primary Examiner* — James Harvey
(74) *Attorney, Agent, or Firm* — Holtz, Holtz & Volek PC

(57) ABSTRACT

A connector comprises a housing and a terminal. The housing has a terminal accommodation portion and a bottom portion. The terminal accommodation portion opens upward in an up-down direction. The bottom portion is positioned under the terminal accommodation portion. The terminal has a base portion, a spring portion and a contact portion. The base portion is embedded in and held by the bottom portion. The spring portion extends upward from the base portion and is accommodated in the terminal accommodation portion. The contact portion is supported by the spring portion. The base portion is enclosed by the bottom portion in a predetermined plane perpendicular to the up-down direction and is in contact with the bottom portion with no gap in the predetermined plane. When the connector is seen from below, the base portion is partially visible, but the terminal accommodation portion is invisible.

7 Claims, 8 Drawing Sheets

(56) References Cited

U.S. PATENT DOCUMENTS

| | | | | |
|---|---|---|---|---|
| 2011/0045708 | A1* | 2/2011 | Ooi | H01R 12/716 439/676 |
| 2012/0214353 | A1* | 8/2012 | Midorikawa | H01R 13/2407 439/733.1 |
| 2013/0295784 | A1 | 11/2013 | Hasegawa | |
| 2015/0207256 | A1* | 7/2015 | Wu et al. | H01R 12/73 439/660 |

* cited by examiner

CONNECTOR

CROSS REFERENCE TO RELATED APPLICATIONS

This application is based on and claims priority under 35 U.S.C. §119 to Japanese Patent Application No. JP2015-195943 filed Oct. 1, 2015, the contents of which are incorporated herein in their entirety by reference.

BACKGROUND OF THE INVENTION

This invention relates to a connector comprising a housing and a terminal which is partially embedded in the housing.

For example, this type of connector is disclosed in JP B 5369125 (Patent Document 1), the content of which is incorporated herein by reference.

Referring to FIG. 14, Patent Document 1 discloses a connector 900 which comprises a housing 910 made of insulator and a plurality of terminals 920 each made of conductor. The terminals 920 are partially embedded in the housing 910 via insert-molding. Each of the terminals 920 has a resilient arm (spring portion) 922 which is resiliently deformable and a connection portion (fixed portion) 924 which is to be soldered to a circuit board (not shown). The housing 910 is formed with hole portions 912 each of which opens downward, or in the negative Z-direction.

When the connector 900 is mounted on the circuit board, a sealing material made of resin is sometimes applied to the circuit board in order to protect the fixed portions 924 of the terminals 920. The thus-applied sealing material might enter inside of the connector 900 through the hole portions 912. When the sealing material enters inside of the connector 900, the sealing material might adhere to the terminal 920 so that the spring portion 922 is made difficult to be resiliently deformed and that the connector 900 is made difficult to be mated with a mating connector.

SUMMARY OF THE INVENTION

It is therefore an object of the present invention to provide a connector which comprises a housing and a terminal partially embedded in the housing and which can prevent adhesion of a sealing material to the terminal.

An aspect of the present invention provides a connector comprising a housing and a terminal. The housing has a terminal accommodation portion and a bottom portion. The terminal accommodation portion opens upward in an up-down direction. The bottom portion is positioned under the terminal accommodation portion. The terminal has a base portion, a spring portion and a contact portion. The base portion is embedded in and held by the bottom portion. The spring portion extends upward from the base portion and is accommodated in the terminal accommodation portion to be resiliently deformable. The contact portion is supported by the spring portion and is movable in a predetermined direction perpendicular to the up-down direction. The base portion is enclosed by the bottom portion in a predetermined plane perpendicular to the up-down direction and is in contact with the bottom portion with no gap in the predetermined plane. When the connector is seen from below, the base portion is partially visible, but the terminal accommodation portion is invisible.

According to an aspect of the present invention, the base portion of the terminal is embedded in and held by the bottom portion which is positioned under the terminal accommodation portion of the housing. The base portion is enclosed by the bottom portion in the predetermined plane perpendicular to the up-down direction and is in contact with the bottom portion with no gap in the predetermined plane. Moreover, when the connector is seen from below, the base portion is partially visible, but the terminal accommodation portion is invisible. The aforementioned structure enables the terminal accommodation portion to be entirely covered by the bottom portion and the base portion from below. This structure can prevent a sealing material from adhering to the terminal which is accommodated in the terminal accommodation portion.

An appreciation of the objectives of the present invention and a more complete understanding of its structure may be had by studying the following description of the preferred embodiment and by referring to the accompanying drawings.

Figure 1:
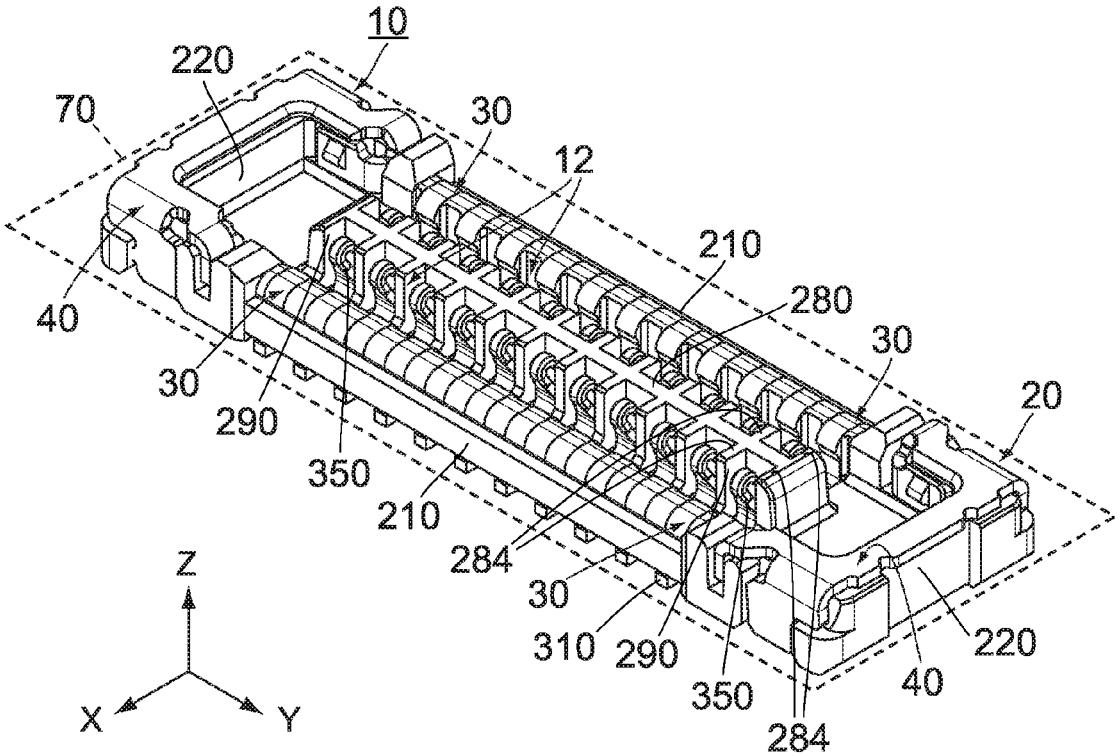
FIG. 1 is a perspective view showing a connector according to an embodiment of the present invention, wherein a part of a circuit board, on which the connector is mounted, is illustrated by dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 5:
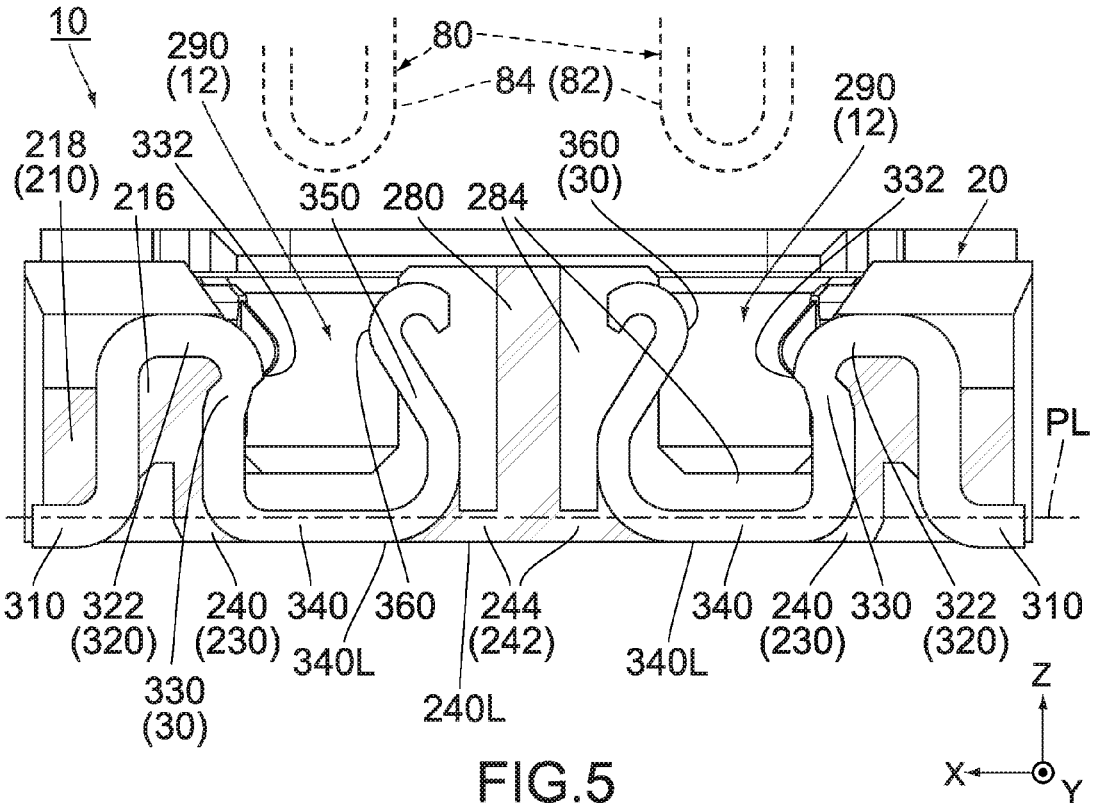
FIG. 5 is a cross-sectional view showing the connector of FIG. 1, taken along line V-V, wherein parts of a mating connector mateable with the connector are illustrated by dashed line.

Referring to FIG. 1, a connector 10 according to an embodiment of the present invention is used under a state where the connector 10 is mounted on an object such as a circuit board 70. Referring to FIG. 5, the connector 10 according to the present embodiment is mateable with a mating connector 80 along a mating direction (the Z-direction: an up-down direction).

Referring to FIGS. 1 and 5, the connector 10 is formed with two receiving portions 12. Each of the receiving portions 12 is a recess which is recessed downward, or in the negative Z-direction, and extends in a pitch direction (the Y-direction). The mating connector 80 has two mating fit portions 82 which correspond to the receiving portions 12, respectively. When the connector 10 is mated with the mating connector 80, the mating fit portions 82 are received in the receiving portions 12, respectively. In other words, each of the receiving portions 12 is a space which receives the corresponding mating fit portion 82 under a mated state where the connector 10 is mated with the mating connector 80. As can be seen from this structure, the connector 10 is a receptacle, and the mating connector 80 is a plug. However, the present invention is not limited thereto but applicable to various connectors.

Referring to FIGS. 1 to 4, the connector 10 comprises a housing 20 made of insulator, a plurality of terminals 30 each made of conductor and two holddowns 40 each made of metal. However, the present invention is not limited thereto. For example, the connector 10 may comprise no holddown 40. Instead, the connector 10 may comprise various members in addition to the aforementioned members.

Figure 6:
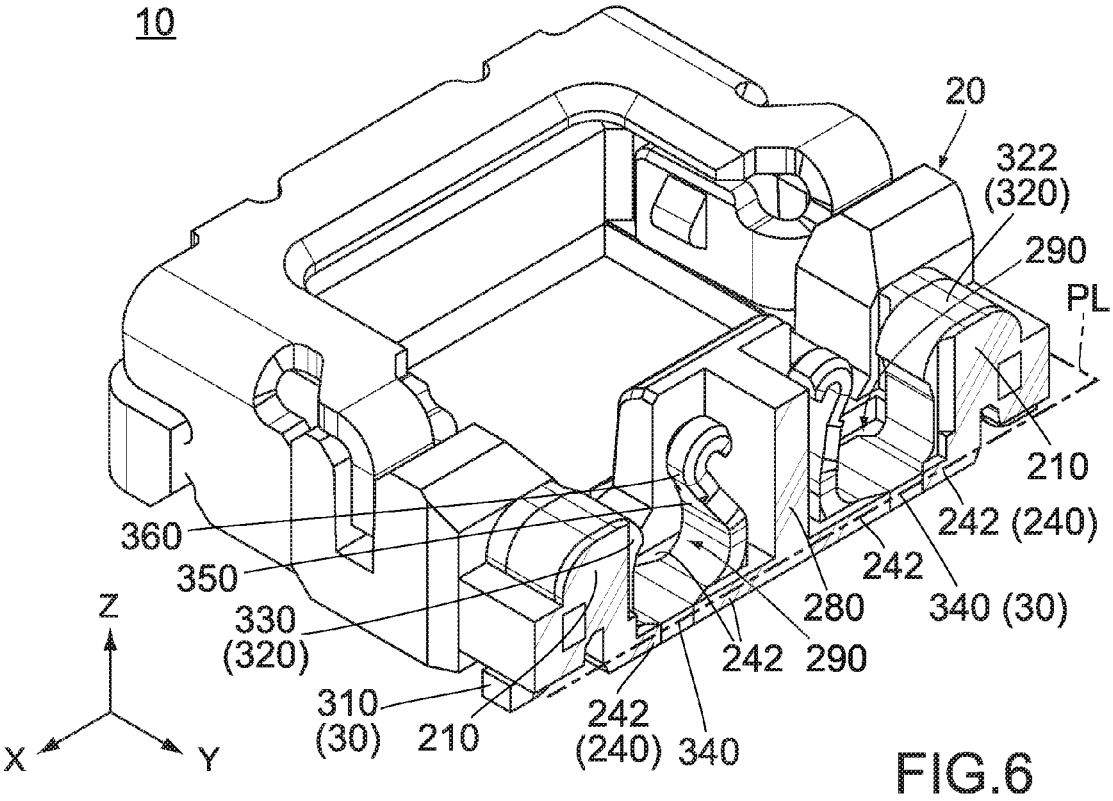
FIG. 6 is a partially cutaway, perspective view showing the connector of FIG. 1.

As can be seen from FIGS. 5 and 6, each of the terminals 30 is partially embedded in the housing 20 via insert-molding. Hereafter, explanation will be made about basic structure of the housing 20 and, subsequently, made about structure of the terminal 30. Thereafter, explanation will be made in further detail about holding mechanism of the housing 20 for holding the terminal 30.

As shown in FIGS. 7 to 10, the housing 20 has a box-like shape which is long in the Y-direction and short in a width direction (the X-direction: a predetermined direction). The housing 20 has two sidewalls 210, two coupling walls 220, a bottom wall 230 and a middle wall (facing wall) 280. Each of the sidewalls 210 extends in the Y-direction. The coupling walls 220 are positioned at opposite ends of the housing 20 in the Y-direction, respectively. Each of the coupling walls 220 couples the two sidewalls 210 in the X-direction. The bottom wall 230 is positioned at a lower end, or the negative Z-side end, of the housing 20. The facing wall 280 is positioned at the middle of the housing 20 in the X-direction and extends in the Y-direction.

Referring to FIGS. 1 to 4, the holddowns 40 are attached to the coupling walls 220, respectively.

Figure 7:
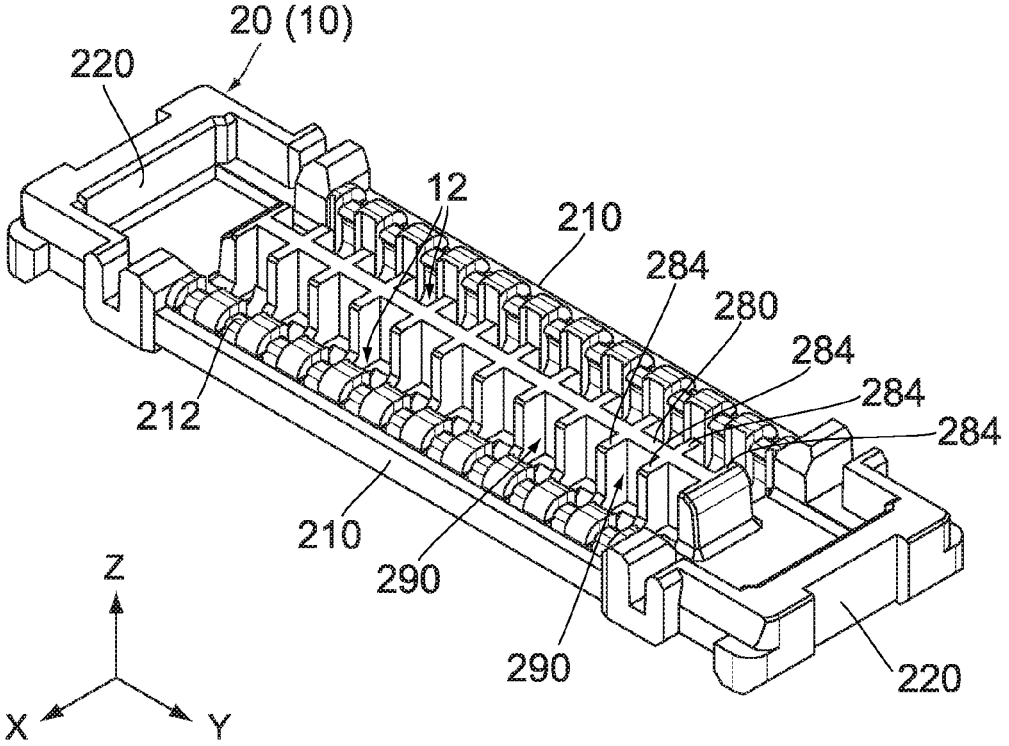
FIG. 7 is a perspective view showing the housing of the connector of FIG. 1.

Referring to FIG. 7, the facing wall 280 faces the positive X-side sidewall 210 across the positive X-side receiving portion 12 in the X-direction and faces the negative X-side sidewall 210 across the negative X-side receiving portion 12 in the X-direction. In other words, in the X-direction, each of the receiving portions 12 is positioned between the facing wall 280 and the corresponding sidewall 210.

Figure 8:
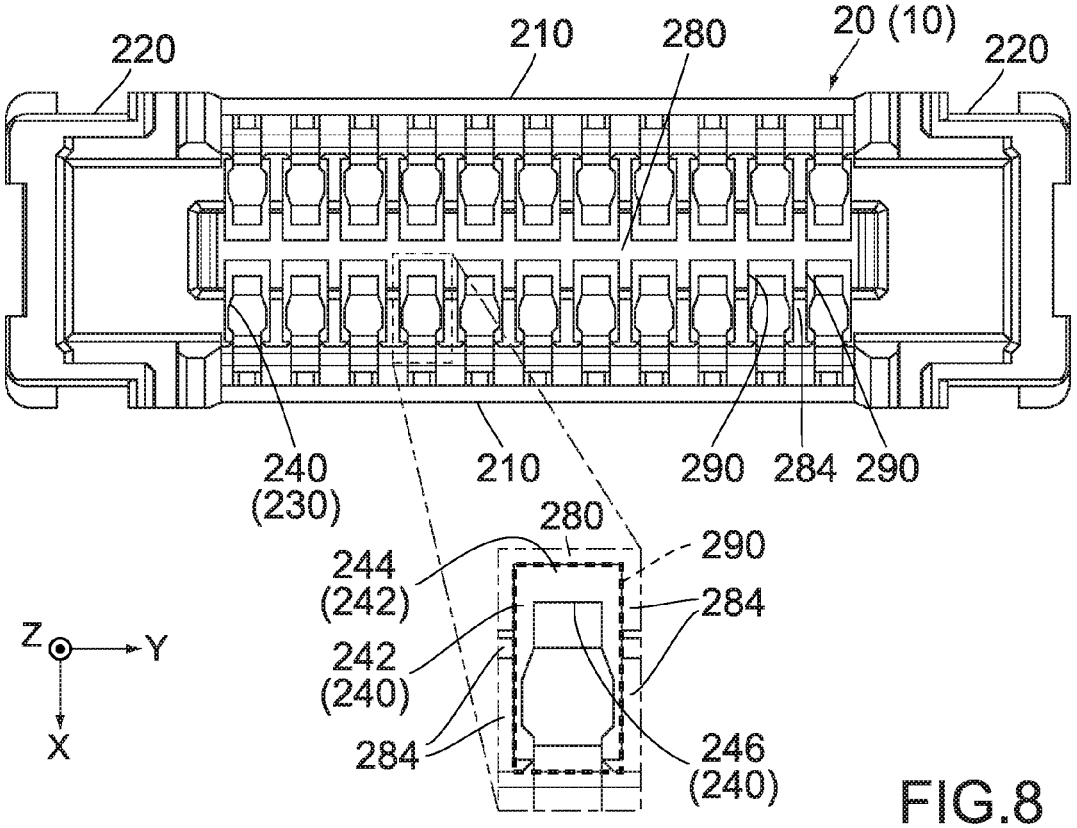
FIG. 8 is a top view showing the housing of FIG. 7, wherein a part in the vicinity of the terminal accommodation portion (the part enclosed by chain dotted line) is enlarged to be illustrated, and an outline of the terminal accommodation portion in the enlarged view is illustrated by dashed line.

Referring to FIGS. 7 and 8, the facing wall 280 has a plurality of partition walls 284. According to the present embodiment, each of the positive X-side part and the negative X-side part of the facing wall 280 is provided with a plurality of the partition walls 284. In each of the positive X-side part and the negative X-side part of the facing wall 280, two of the partition walls 284 are provided at opposite ends of the facing wall 280 in the Y-direction, respectively, and the remaining partition walls 284 are provided at regular intervals between the opposite ends of the facing wall 280 in the Y-direction. Each of the positive X-side partition walls 284 extends toward the positive X-side sidewall 210 along the positive X-direction, and each of the negative X-side partition walls 284 extends toward the negative X-side sidewall 210 along the negative X-direction.

The housing 20 has a plurality of terminal accommodation portions 290. Each of the terminal accommodation portions 290 according to the present embodiment is a space which is positioned between two of the partition walls 284 adjacent to each other in the Y-direction and which is positioned between the facing wall 280 and one of the sidewalls 210 in the X-direction. Each of the terminal accommodation portions 290 is a part of one of the receiving portions 12. In other words, in the Y-direction, each of the receiving portions 12 is positioned between two of the terminal accommodation portions 290 which are formed at the opposite ends of the facing wall 280 in the Y-direction, respectively, and includes these two terminal accommodation portions 290.

According to the present embodiment, the housing 20 is provided with two rows of the terminal accommodation portions 290. The two rows are apart from each other in the X-direction. In each row, the terminal accommodation portions 290 are arranged in the Y-direction. However, the present invention is not limited thereto. For example, only one of the terminal accommodation portions 290 may be provided in each row. Moreover, the housing 20 may be formed with only one of the rows of the terminal accommodation portions 290. In this case, the housing 20 may have only one of the positive X-side sidewall 210 and the negative X-side sidewall 210, and the facing wall 280 may work as a remaining one of the positive X-side sidewall and the negative X-side sidewall.

Figure 9:
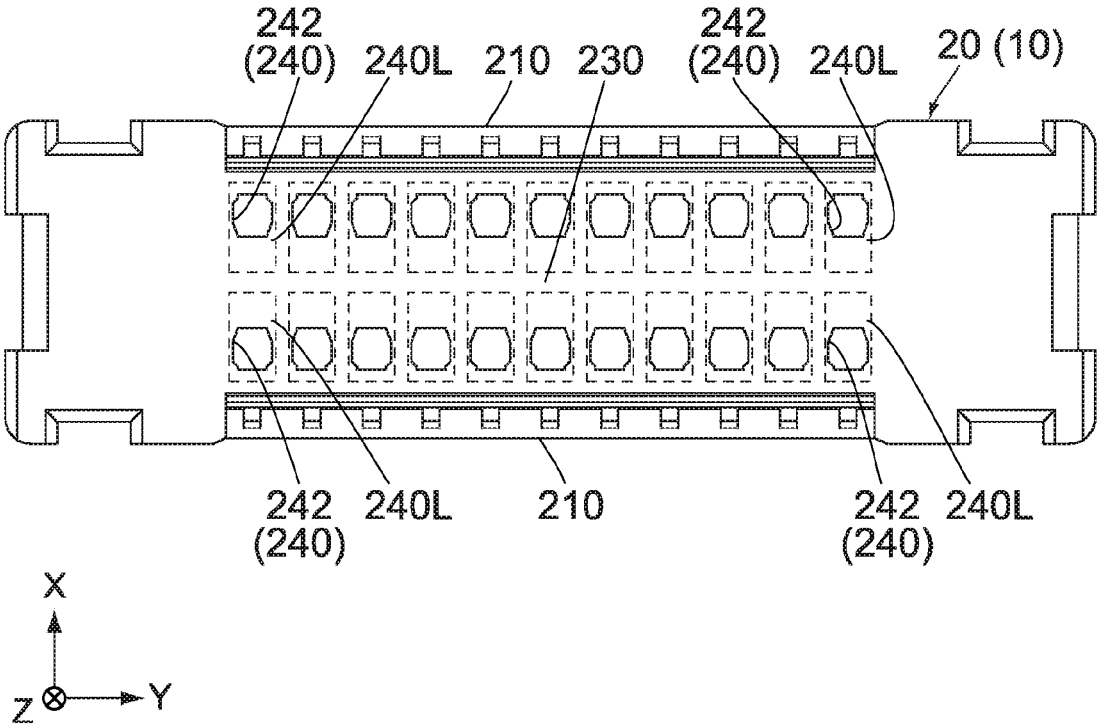
FIG. 9 is a bottom view showing the housing of FIG. 7, wherein outlines of the bottom portions of the bottom wall of the housing are illustrated by dashed line.
Figure 10:
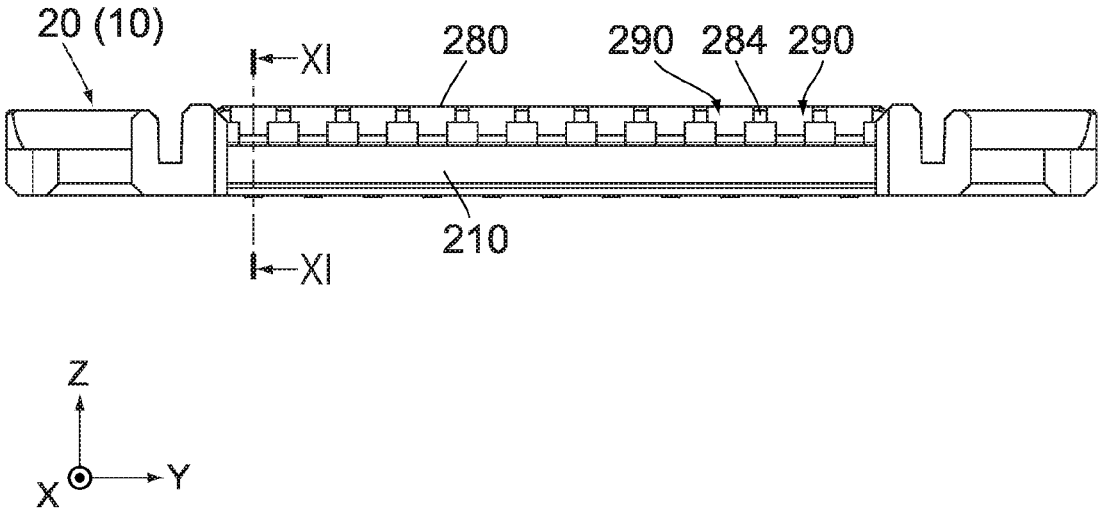
FIG. 10 is a side view showing the housing of FIG. 7.

Referring to FIGS. 7, 8 and 10, each of the terminal accommodation portions 290 opens upward in the Z-direction, or opens in the positive Z-direction. Referring to FIG. 9 together with FIG. 8, the housing 20 is provided with a plurality of bottom portions 240 which correspond to the terminal accommodation portions 290, respectively, and each of which is formed under the corresponding terminal accommodation portion 290. In other words, the housing 20 has the bottom portions 240 which are positioned under the terminal accommodation portions 290, respectively. Each of the bottom portions 240 has a lower surface 240L. As can be seen from FIG. 9, each of the bottom portions 240 is a part of the bottom wall 230 of the housing 20. Therefore, the lower surface 240L of each of the bottom portions 240 is a part of a lower surface, or the negative Z-side surface, of the bottom wall 230. In the present embodiment, there is no visible or distinct boundary between each of the bottom portions 240 and the other part of the bottom wall 230. However, the lower surface 240L of each of the bottom portions 240 may be formed with a boundary part such as a groove.

Figure 2:
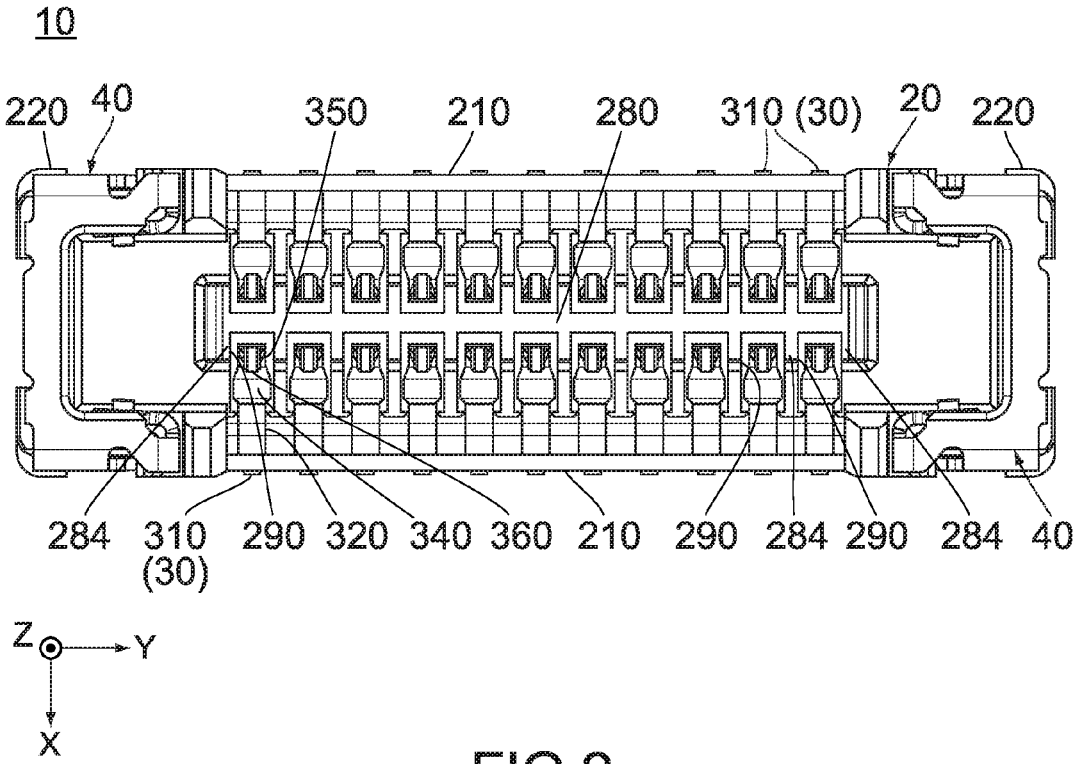
FIG. 2 is a top view showing the connector of FIG. 1.

Referring to FIGS. 1 and 2, the terminals 30 are grouped into two rows separated from each other in the X-direction and held by the housing 20. More specifically, the terminals 30 are accommodated and held in the terminal accommodation portions 290, respectively, which are grouped into the two rows as previously described. The thus-accommodated terminals 30 are arranged in the Y-direction in each row.

Referring to FIG. 6, the terminals 30 have shapes same as one another. In other words, in the present embodiment, all of the terminals 30 are the same components. Moreover, the terminals 30 arranged in the positive X-side row are positioned to be mirror symmetric to the terminals 30 arranged in the negative X-side row with respect to the YZ-plane. However, the present invention is not limited thereto. For example, the positive X-side terminal 30 and the negative X-side terminal 30 may have shapes slightly different from each other.

Figure 13:
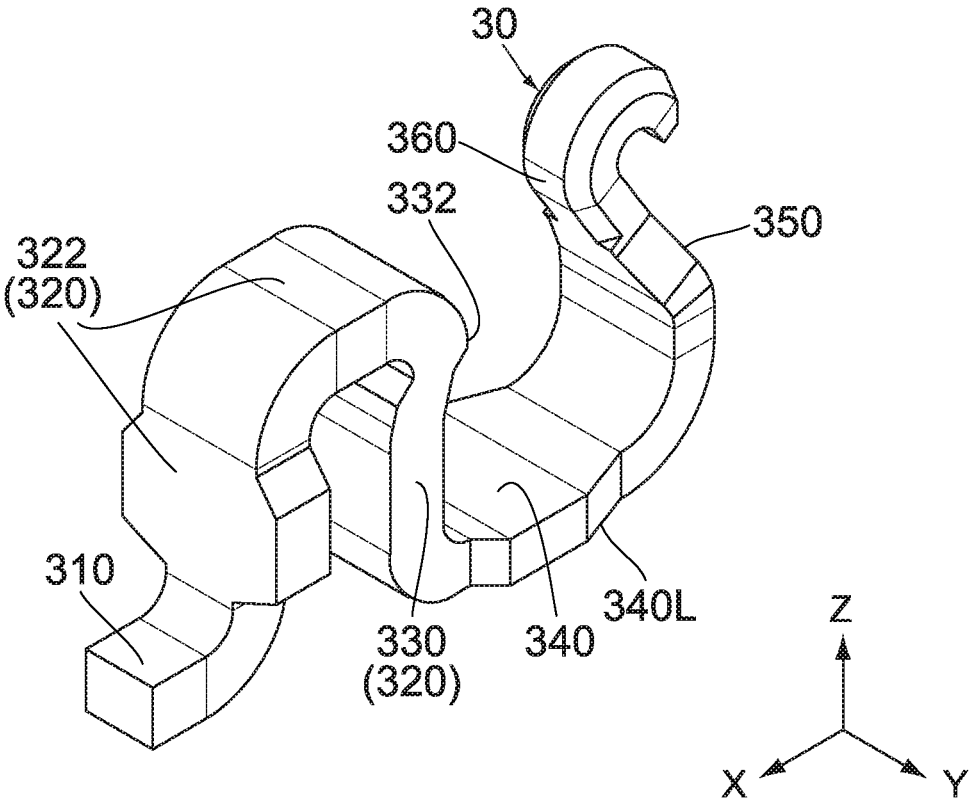
FIG. 13 is a perspective view showing a terminal of the connector of FIG. 1.
Figure 14:
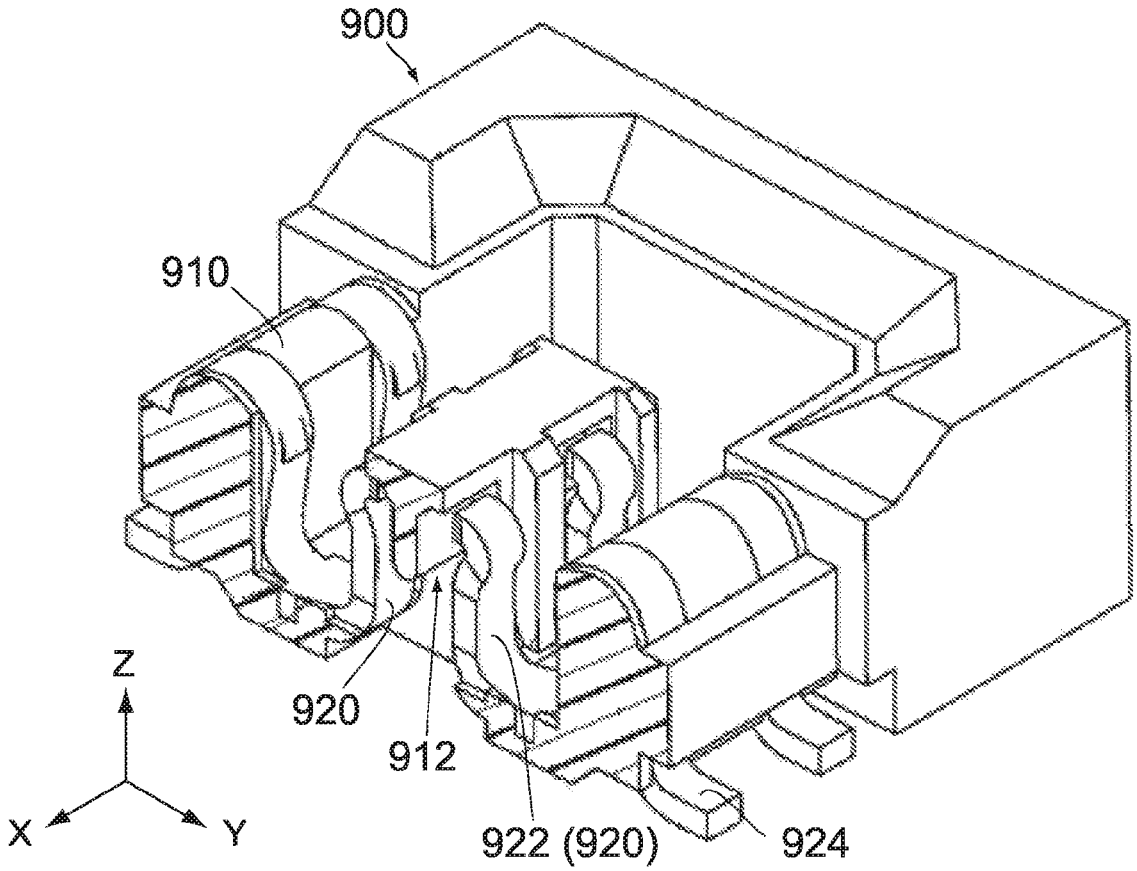
FIG.14 PRIOR ART
FIG. 14 is a partially cutaway, perspective view showing a connector of Patent Document 1.

Referring to FIG. 13, each of the terminals 30 according to the present embodiment is a single metal plate which is bent. However, the present invention is not limited thereto. Each of the terminals 30 may be a single metal plate which is punched out to have a predetermined shape. Instead, each of the terminals 30 may be formed of a plurality of members.

As shown in FIG. 13, each of the terminals 30 has a fixed portion 310, a held portion 320, a base portion 340, a spring portion 350 and a contact portion 360. The fixed portion 310, the held portion 320, the base portion 340 and the spring portion 350 are arranged in this order and extend continuously.

The base portion 340 has a flat plate-like shape which is perpendicular to the Z-direction and partially protrudes in the Y-direction. The thus-shaped base portion 340 has an upper surface (the positive Z-side surface) and a lower surface 340L each of which is a flat surface perpendicular to the Z-direction. In the present embodiment, with no consideration of manufacturing error, any part of the base portion 340 has a thickness, or a size in the Z-direction, same as that of any other part of the base portion 340. However, the thickness of a part of the base portion 340 may be slightly different from that of the other part of the base portion 340.

The spring portion 350 extends upward from an inner end of the base portion 340 in the X-direction. The spring portion 350 is supported by the base portion 340 and is resiliently deformable in the XZ-plane. The spring portion 350 has an upper part, or the positive Z-side part, which protrudes outward in the X-direction to form the contact portion 360. The thus-formed contact portion 360 is supported by the spring portion 350. The contact portion 360 is movable in the X-direction because of the resilient deformation of the spring portion 350.

The held portion 320 extends from an outer end of the base portion 340 in the X-direction to have an inverted U-like shape. In detail, the held portion 320 has a facing portion 330 of an I-like shape and an extending portion 322 of an inverted L-like shape. The facing portion 330 extends upward from the outer end of the base portion 340 in the X-direction. The facing portion 330 faces the spring portion 350 in the X-direction. The facing portion 330 is provided with a protruding portion 332 which protrudes toward the contact portion 360. The extending portion 322 extends outward in the X-direction from an upper end, or the positive Z-side end, of the facing portion 330 and, subsequently, extends downward. The fixed portion 310 extends outward in the X-direction from an outer end of the held portion 320 in the X-direction, or from a lower end of the extending portion 322.

Referring to FIGS. 1 and 2, the spring portion 350 of each of the terminals 30 is accommodated in the corresponding terminal accommodation portions 290 to be resiliently deformable. In other words, the terminal accommodation portion 290 is a space for allowing the resilient deformation of the spring portion 350 of the corresponding terminal 30. In particular, the terminal accommodation portion 290 allows the spring portion 350 to be resiliently deformed also in the Y-direction to some extent. In other words, the terminal accommodation portion 290 is positioned in a range in the Y-direction in which the spring portion 350 is resiliently deformable.

Referring to FIG. 1, when the connector 10 is mounted on the circuit board 70, the fixed portions 310 are connected and fixed to conductive patterns (not shown) of the circuit board 70, respectively, via soldering, etc. Referring to FIG. 5, under the mated state, the contact portion 360 of each of the terminals 30 is brought into contact with corresponding mating terminal 84 of one of the mating fit portions 82 of the mating connector 80. In each of the terminals 30, a distance between the protruding portion 332 and the contact portion 360 in the X-direction has a dimension smaller than that of a size of the mating fit portion 82 in the X-direction. Therefore, each of the mating terminals 84 is sandwiched between the protruding portion 332 and the contact portion 360 of the corresponding terminal 30 under the mated state. As a result, the connector 10 and the mating connector 80 are electrically connected with each other.

Hereafter, explanation will be made in detail about the housing 20, especially about the holding mechanism of the terminal accommodation portion 290 for holding the terminal 30.

Figure 11:
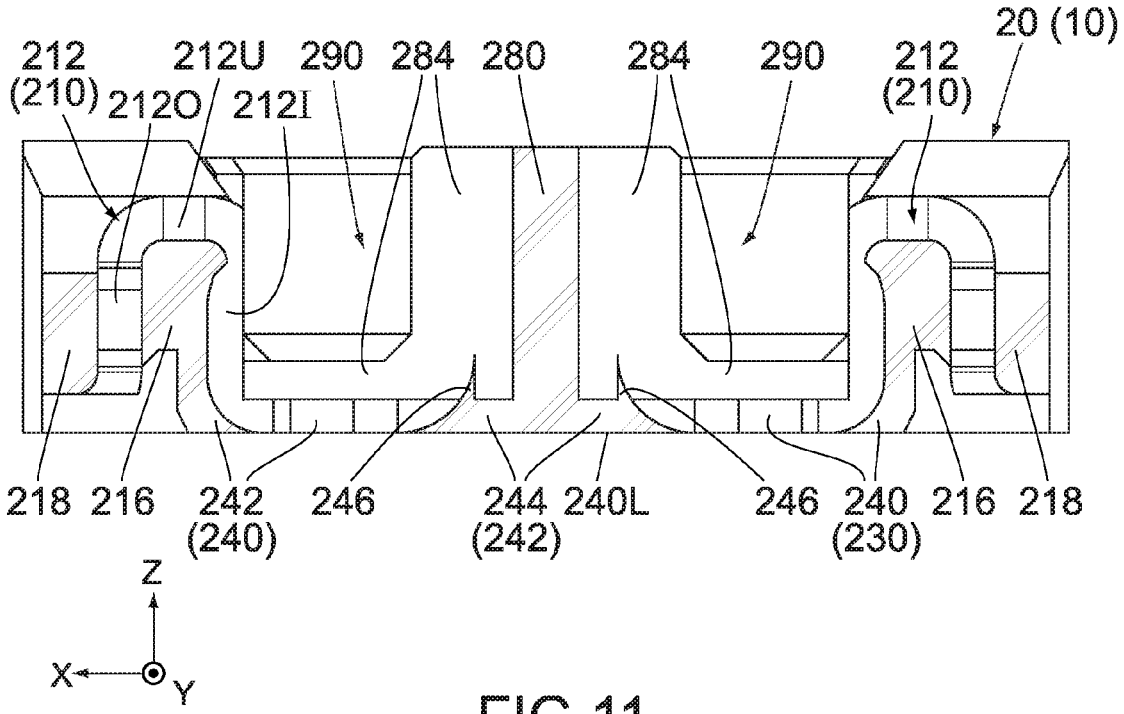
FIG. 11 is a cross-sectional view showing the housing of FIG. 10, taken along line XI-XI.
Figure 12:
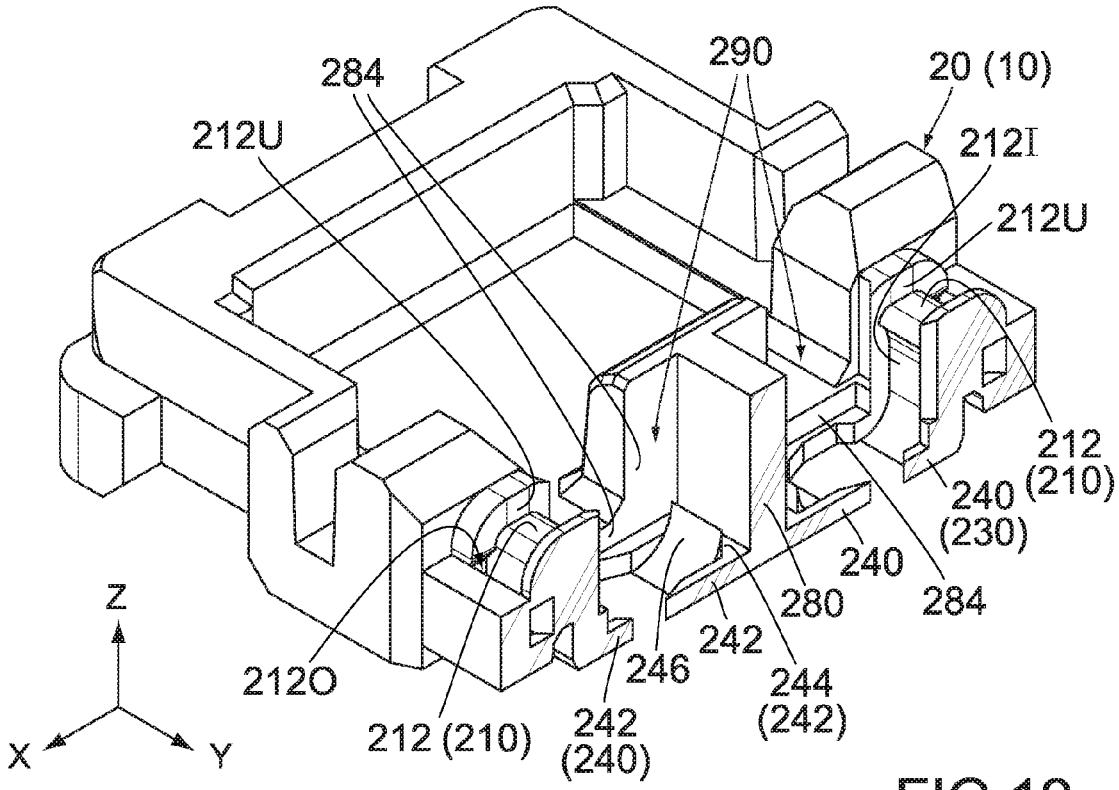
FIG. 12 is a partially cutaway, perspective view showing the housing of FIG. 7.

Referring to FIGS. 11 and 12, the sidewalls 210 of the housing 20 have a plurality of channels 212 which correspond to the terminal accommodation portions 290, respectively. Each of the channels 212 includes an inner channel 212I, an upper channel 212U and an outer channel 212O. The inner channel 212I is a channel formed in a facing part of the sidewall 210, wherein the facing part faces the corresponding terminal accommodation portion 290. The inner channel 212I is recessed outward in the X-direction and extends upward from the bottom portion 240. The upper channel 212U is a channel formed in an upper part of the sidewall 210. The upper channel 212U is recessed downward and extends outward in the X-direction from an upper end of the inner channel 212I. The outer channel 212O is a hole piercing the sidewall 210 in the Z-direction. The outer channel 212O extends downward from an outer end of the upper channel 212U in the X-direction.

The housing 20 has a plurality of inside portions 216 and a plurality of outside portions 218 which correspond to the inside portions 216, respectively. The inside portions 216 are provided to correspond to the terminal accommodation portions 290, respectively. Similarly, the outside portions 218 are provided to correspond to the terminal accommodation portions 290, respectively. Each of the inside portions 216 and the outside portions 218 is a part of the sidewall 210 and corresponds to one of the channels 212. In detail, each of the inside portions 216 is a surrounded part of the sidewall 210, wherein the surrounded part is surrounded on three sides by the corresponding channel 212 in a plane defined by the X-direction and the Z-direction, or in the XZ-plane. Each of the outside portion 218 is an outer part of the sidewall 210, wherein the outer part is positioned outward of the corresponding outer channel 212O in the X-direction. Thus, each of the outer channels 212O is positioned between the corresponding inside portion 216 and the corresponding outside portion 218 in the X-direction.

Referring to FIGS. 5 and 6, the held portion 320 of each of the terminals 30 is insert-molded in the sidewall 210 of the housing 20 and embedded in and held by the corresponding channel 212 of the sidewall 210. The thus-embedded held portion 320 couples the base portion 340 and the fixed portion 310 to each other while passing through the channel 212. The inside portion 216 of the sidewall 210 is positioned inside of the held portion 320 in the XZ-plane. In particular, the inside portion 216 is positioned under the held portion 320, and the outside portion 218 is positioned over the fixed portion 310. The inside portion 216 and the outside portion 218 partially interpose the held portion 320 in the X-direction. This structure prevents any force in any direction from removing the terminal 30 from the housing 20 unless the sidewall 210 is broken. Moreover, since the most part of the held portion 320 is not exposed outward, the terminal 30 has a high corrosion resistance.

Referring to FIGS. 9, 11 and 12, each of the bottom portions 240 has a flat plate-like shape as a whole. In detail, each of the bottom portions 240 has a main portion 242 and a projecting portion 246. The main portion 242 has a flat plate-like shape perpendicular to the Z-direction. The thus-shaped main portion 242 has an upper surface and a lower surface each of which is a flat surface perpendicular to the Z-direction. In the present embodiment, the lower surface of the main portion 242 is the lower surface 240L of the bottom portion 240. Referring to FIGS. 11 and 12, each of the bottom portions 240 has a thin portion 244. The thin portion 244 according to the present embodiment is a part of the main portion 242. In detail, the thin portion 244 is an inner end portion of the main portion 242 in the X-direction. The projecting portion 246 extends upward from the thin portion 244.

Referring to FIGS. 5 and 6, the base portion 340 of the terminal 30 is embedded in and held by the bottom portion 240 via insert-molding. In particular, the base portion 340 is enclosed by the bottom portion 240 on four sides in a predetermined plane PL perpendicular to the Z-direction and is in contact with the bottom portion 240 with no gap in the predetermined plane PL. In other words, the base portion 340 is firmly stuck to the bottom portion 240 and cannot be removed from the bottom portion 240 unless the bottom portion 240 is broken. Moreover, the base portion 340 partially protrudes outward in the Y-direction. This protruding structure enables the housing 20 to more firmly hold the base portion 340.

Referring to FIG. 2, when the connector 10 is seen from above, each of the base portion 340, the spring portion 350 and the contact portion 360 is partially visible. In detail, referring to FIGS. 5 and 6, the spring portion 350 and the contact portion 360 of the terminal 30 are not covered from above. In addition, the upper surface of the base portion 340 is not covered from above except a part positioned under the facing portion 330. According to this structure, if the bottom portion 240 has a small holding force which is insufficient to hold the base portion 340, the base portion 340 might be removed from the bottom portion 240 because of an upward force which the mating terminal 84 applies to the contact portion 360 of the terminal 30 upon removal of the mating connector 80 from the mated connector 10. In contrast, the base portion 340 according to the present embodiment is securely held by the bottom portion 240 via insert-molding as described above. Therefore, the spring portion 350 and the contact portion 360 are hardly moved upward even when the mating connector 80 is removed from the connector 10.

Figure 3:
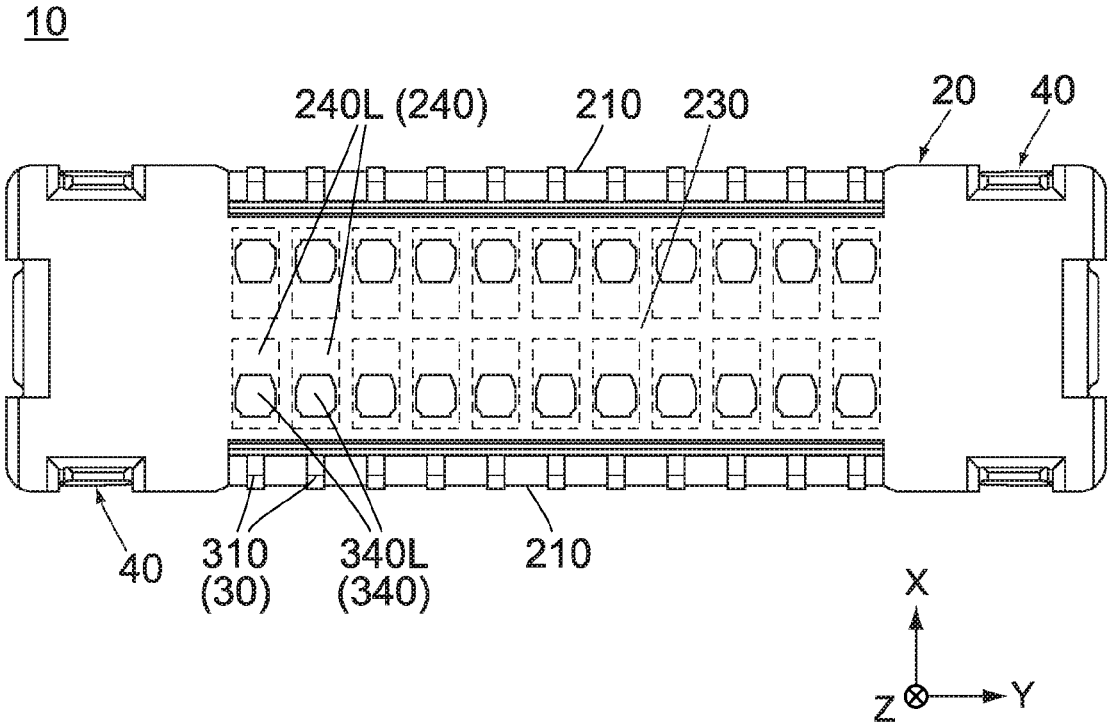
FIG. 3 is a bottom view showing the connector of FIG. 1, wherein outlines of bottom portions of a bottom wall of a housing of the connector are illustrated by dashed line.
Figure 4:
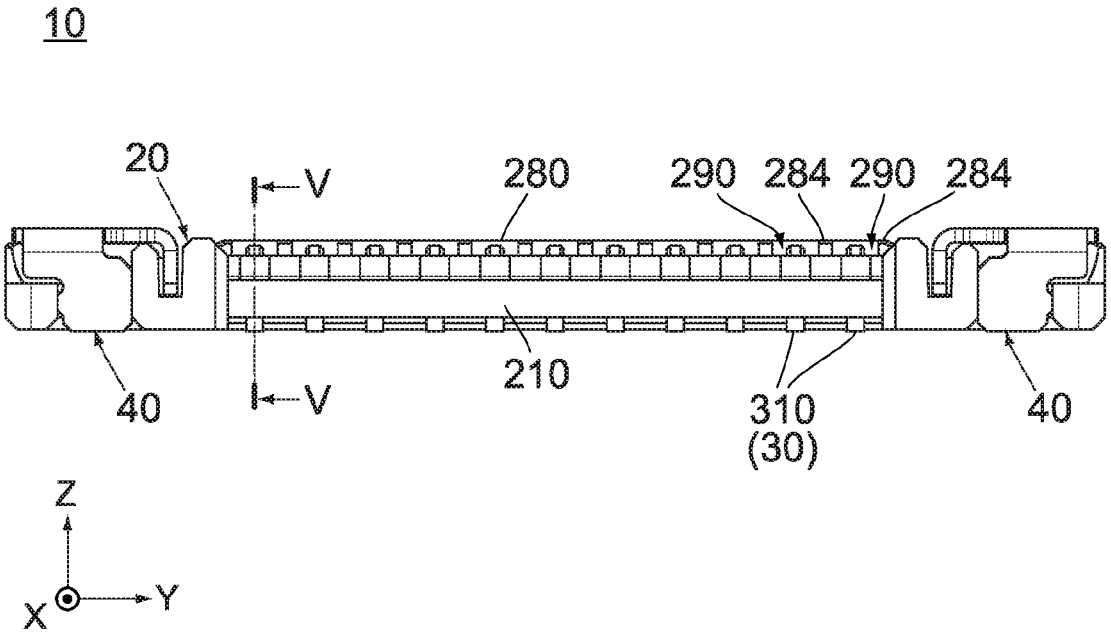
FIG. 4 is a side view showing the connector of FIG. 1.

Referring to FIGS. 3, 5 and 6, when the connector 10 is seen from below, the base portion 340 surrounded by the bottom portion 240 is partially visible, but the terminal accommodation portion 290 is invisible. In other words, the terminal accommodation portion 290 is entirely covered by the bottom portion 240 and the base portion 340. Referring to FIG. 12 together with FIG. 6, if the base portion 340 is removed from the bottom portion 240, the bottom portion 240 is formed with a hole which extends from below the connector 10 into the inside of the terminal accommodation portion 290. From another perspective different from that of the explanation described above, the base portion 340 entirely fills this hole. The base portion 340 of the terminal 30 insert-molded in the housing 20 entirely covers the terminal accommodation portion 290 so that the terminal accommodation portion 290 is invisible. Even if a sealing material made of resin is applied to the circuit board 70 (see FIG. 1) under a state where the connector 10 is mounted on the circuit board 70, the base portion 340 prevents the sealing material from invading the inside of the terminal accommodation portion 290.

Referring to FIG. 3 together with FIG. 9, in the present embodiment, the bottom wall 230 of the housing 20 is formed with no hole. This structure more reliably prevents the invasion of the sealing material. However, the present invention is not limited thereto. The bottom wall 230 may be formed with one or more holes each of which is positioned to be far away from each of the bottom portions 240, provided that the bottom wall 230 has no hole which is positioned under the receiving portion 12 (see FIG. 1) to pierce the bottom wall 230 in the Z-direction. For example, the bottom wall 230 may be formed with holes each of which is positioned in the vicinity of an end of the bottom wall 230 in the Y-direction and which can be used for fixing the holddown 40 to the circuit board 70 (see FIG. 1).

Referring to FIGS. 3 and 6, the base portion 340 is exposed outward at the bottom portion 240 of the bottom wall 230. This structure makes a distance between an upper end of the base portion 340 and a lower end of the bottom portion 240 small in comparison with another structure in which the base portion 340 is embedded in an upper part of the bottom portion 240 and is not exposed downward. In other words, the connector 10 can be reduced in its size in the Z-direction. In particular, according to the present embodiment, a thickness of the main portion 242 of the bottom portion 240, or a size of the main portion 242 in the Z-direction, is equal to another thickness of the base portion 340, or another size of the base portion 340 in the Z-direction. Moreover, the lower surface 340L of the base portion 340 is flush with the lower surface 240L of the bottom portion 240. In other words, a position of the lower surface 340L in the Z-direction is equal to another position of the lower surface 240L in the Z-direction, and the lower surface 240L and the lower surface 340L are positioned on a common plane perpendicular to the Z-direction. The aforementioned arrangement allows the connector 10 to be further reduced in its size in the Z-direction. However, the present invention is not limited thereto. For example, the lower surface 340L may be positioned slightly above the lower surface 240L.

Referring to FIG. 5 together with FIGS. 11 and 12, the projecting portion 246 of the bottom portion 240 partially extends upward from the main portion 242 and couples the thin portion 244 of the main portion 242 to a lower end portion of the spring portion 350. The thin portion 244 is positioned between the spring portion 350 and the facing wall 280 in the X-direction. Moreover, a thickness of the thin portion 244, or a size of the thin portion 244 in the Z-direction, is small. Therefore, the spring portion 350 can be resiliently deformed easily together with the projecting portion 246 and the thin portion 244. In the present embodiment, the thickness of the thin portion 244 is equal to the thickness of the base portion 340. However, the present invention is not limited thereto. The thickness of the thin portion 244 may be less than the thickness of the base portion 340, provided that the thin portion 244 does not have a degraded strength. Moreover, in a case where the spring portion 350 solely has a sufficient spring property, no projecting portion 246 and no thin portion 244 may be provided.

The present embodiment can be variously modified, for example, as described below, in addition to the already explained modifications.

Referring to FIG. 5, each of the structure of the housing 20 and the structure of the terminal 30 can be variously modified. For example, the held portion 320 of the terminal 30 does not need to have the extending portion 322. In this case, the fixed portion 310 may extend from the upper end of the facing portion 330 of the held portion 320. Moreover, the terminal 30 does not need to have the held portion 320. In this case, the fixed portion 310 may extend from the base portion 340, or a part of the base portion 340 may work as the fixed portion 310.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a housing and a terminal, wherein:

the housing has a terminal accommodation portion and a bottom portion;

the terminal accommodation portion opens upward in an up-down direction;

the bottom portion is positioned under the terminal accommodation portion;

the terminal has a base portion, a spring portion and a contact portion;

the base portion is embedded in and held by the bottom portion;

the spring portion extends upward from the base portion and is accommodated in the terminal accommodation portion to be resiliently deformable;

the contact portion is supported by the spring portion and is movable in a predetermined direction perpendicular to the up-down direction;

the base portion is enclosed by the bottom portion in a predetermined plane perpendicular to the up-down direction and is in contact with the bottom portion with no gap in the predetermined plane; and when the connector is seen from below, the base portion is partially visible, but the terminal accommodation portion is invisible.

2. The connector as recited in claim 1, wherein:

the housing has a facing wall;

the facing wall faces the spring portion in the predetermined direction;

the bottom portion has a thin portion;

the thin portion is positioned between the spring portion and the facing wall in the predetermined direction; and a size of the thin portion in the up-down direction is equal to or less than another size of the base portion in the up-down direction.

3. The connector as recited in claim 1, wherein:

the bottom portion has a main portion and a projecting portion;

the main portion has a flat plate-like shape perpendicular to the up-down direction; and the projecting portion partially extends upward from the main portion.

4. The connector as recited in claim 1, wherein:

each of the bottom portion and the base portion has a lower surface; and the lower surface of the bottom portion and the lower surface of the base portion are positioned on a common plane perpendicular to the up-down direction.

5. The connector as recited in claim 1, wherein:

the connector is a receptacle;

the terminal has a facing portion; and the facing portion extends upward from the base portion and faces the spring portion in the predetermined direction.

6. The connector as recited in claim 1, wherein:

the terminal has a held portion and a fixed portion;

the held portion extends from the base portion to have an inverted U-like shape;

the fixed portion extends outward in the predetermined direction from the held portion;

the housing has an inside portion and an outside portion;

the inside portion is positioned inside of the held portion in a plane defined by the up-down direction and the predetermined direction;

the outside portion is positioned over the fixed portion; and the inside portion and the outside portion partially interpose the held portion in the predetermined direction.

7. The connector as recited in claim 1, wherein when the connector is seen from above, each of the base portion, the spring portion and the contact portion is partially visible.

* * * * *